US012742584B2

(12) United States Patent
Thomas et al.

(10) Patent No.: US 12,742,584 B2
(45) Date of Patent: Sep. 22, 2026

(54) REFRIGERATOR APPLIANCE POST-COOL FAN OPERATION

(71) Applicant: Haier US Appliance Solutions, Inc., Wilmington, DE (US)

(72) Inventors: Ryan Joseph Thomas, Louisville, KY (US); Kristin Marie Weirich, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 107 days.

(21) Appl. No.: 18/761,010

(22) Filed: Jul. 1, 2024

(65) Prior Publication Data

US 2026/0002723 A1 Jan. 1, 2026

(51) Int. Cl.
*F25D 17/06* (2006.01)

(52) U.S. Cl.
CPC ..... *F25D 17/067* (2013.01)

(58) Field of Classification Search
CPC ..... F25D 17/067; F25D 2600/02; F25D 2600/112
See application file for complete search history.

(56) References Cited

U.S. PATENT DOCUMENTS

| | | | | |
|---|---|---|---|---|
| 7,454,918 | B2 | 11/2008 | Davern et al. | |
| 8,763,920 | B1 * | 7/2014 | Walsh | F24F 11/70 |
| 9,970,700 | B2 | 5/2018 | Cho et al. | |
| 10,533,768 | B2 * | 1/2020 | Mowris | F04D 27/004 |
| 11,421,934 | B2 | 8/2022 | Song et al. | |
| 2014/0056723 | A1 * | 2/2014 | Buendia Garcia | F25B 49/022 417/279 |
| 2015/0060557 | A1 * | 3/2015 | Lau | F24F 11/76 236/44 C |
| 2015/0159905 | A1 * | 6/2015 | Lau | F24D 19/1084 62/89 |
| 2017/0343269 | A1 * | 11/2017 | Kim | F25D 23/068 |
| 2021/0063068 | A1 | 3/2021 | Lee et al. | |

FOREIGN PATENT DOCUMENTS

| | | | | |
|---|---|---|---|---|
| WO | WO-2020151593 A1 * | 7/2020 | | F25D 17/06 |
| WO | WO2024061451 A1 | 3/2024 | | |

OTHER PUBLICATIONS

WO-2020151593-A1 Translation (Year: 2020).*

* cited by examiner

*Primary Examiner* — David J Teitelbaum
(74) *Attorney, Agent, or Firm* — Dority & Manning, P.A.

(57) ABSTRACT

A method of operating a refrigerator appliance includes operating a compressor of the refrigerator appliance to flow a refrigerant to an evaporator of the refrigerator appliance. The method also includes operating a fan to motivate a flow of air between the evaporator and a compartment of the refrigerator appliance while operating the compressor to flow the refrigerant to the evaporator. The compartment is thereby cooled. The method further includes stopping the flow of refrigerant to the evaporator. The method also includes determining a post-cool fan time based on a temperature setpoint of the compartment of the refrigerator appliance. The method further includes operating the fan for the determined post-cool fan time after stopping the flow of refrigerant to the evaporator.

18 Claims, 5 Drawing Sheets

REFRIGERATOR APPLIANCE POST-COOL FAN OPERATION

FIELD OF THE INVENTION

The present subject matter relates generally to refrigerator appliances, and more particularly to systems and methods for circulating air within refrigerator appliances.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

A sealed system of the refrigerator appliance provides a flow of air to cool the chilled chamber. Such flow of air may be motivated by a fan, e.g., during a cooling cycle in which refrigerant is flowed to an evaporator of the sealed system. After the cooling cycle, e.g., when the flow of refrigerant to the evaporator is stopped, the fan may continue to run, such as for frost management, further cooling of the chilled chamber, and/or to manage humidity in the chilled chamber.

Conventional refrigerator appliances may run the fan after the cooling cycle for a static predetermined time, or may run the fan after the cooling cycle in response to one or more measured temperatures, e.g., a temperature measured at the evaporator. Running the fan for a static predetermined time is not always optimal because the predetermined time is only optimized for one setpoint temperature of the chilled chamber. Running the fan after the cooling cycle based on measured temperature(s) may provide inconsistent results and may lead to running the fan for too long after the cooling cycle, or not long enough.

Accordingly, improved systems and methods for circulating air within refrigerator appliances, such as during a post-cooling time, would be useful.

BRIEF DESCRIPTION OF THE INVENTION

Aspects and advantages of the invention will be set forth in part in the following description, or may be apparent from the description, or may be learned through practice of the invention.

In one exemplary embodiment, a method of operating a refrigerator appliance is provided. The method includes operating a compressor of the refrigerator appliance to flow a refrigerant to an evaporator of the refrigerator appliance. The method also includes operating a fan to motivate a flow of air between the evaporator and a compartment of the refrigerator appliance while operating the compressor to flow the refrigerant to the evaporator. The compartment is thereby cooled. The method further includes stopping the flow of refrigerant to the evaporator. The method also includes determining a post-cool fan time based on a temperature setpoint of the compartment of the refrigerator appliance. The method further includes operating the fan for the determined post-cool fan time after stopping the flow of refrigerant to the evaporator.

In another exemplary embodiment, a refrigerator appliance is provided. The refrigerator appliance includes a compressor, an evaporator, a fan, and a compartment. The refrigerator appliance also includes a controller. The controller is configured for operating the compressor to flow a refrigerant to the evaporator and operating the fan to motivate a flow of air between the evaporator and the compartment while operating the compressor to flow the refrigerant to the evaporator, whereby the compartment is cooled. The controller is also configured for stopping the flow of refrigerant to the evaporator. The controller is further configured for determining a post-cool fan time based on a temperature setpoint of the compartment of the refrigerator appliance. The controller is also configured for operating the fan for the determined post-cool fan time after stopping the flow of refrigerant to the evaporator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
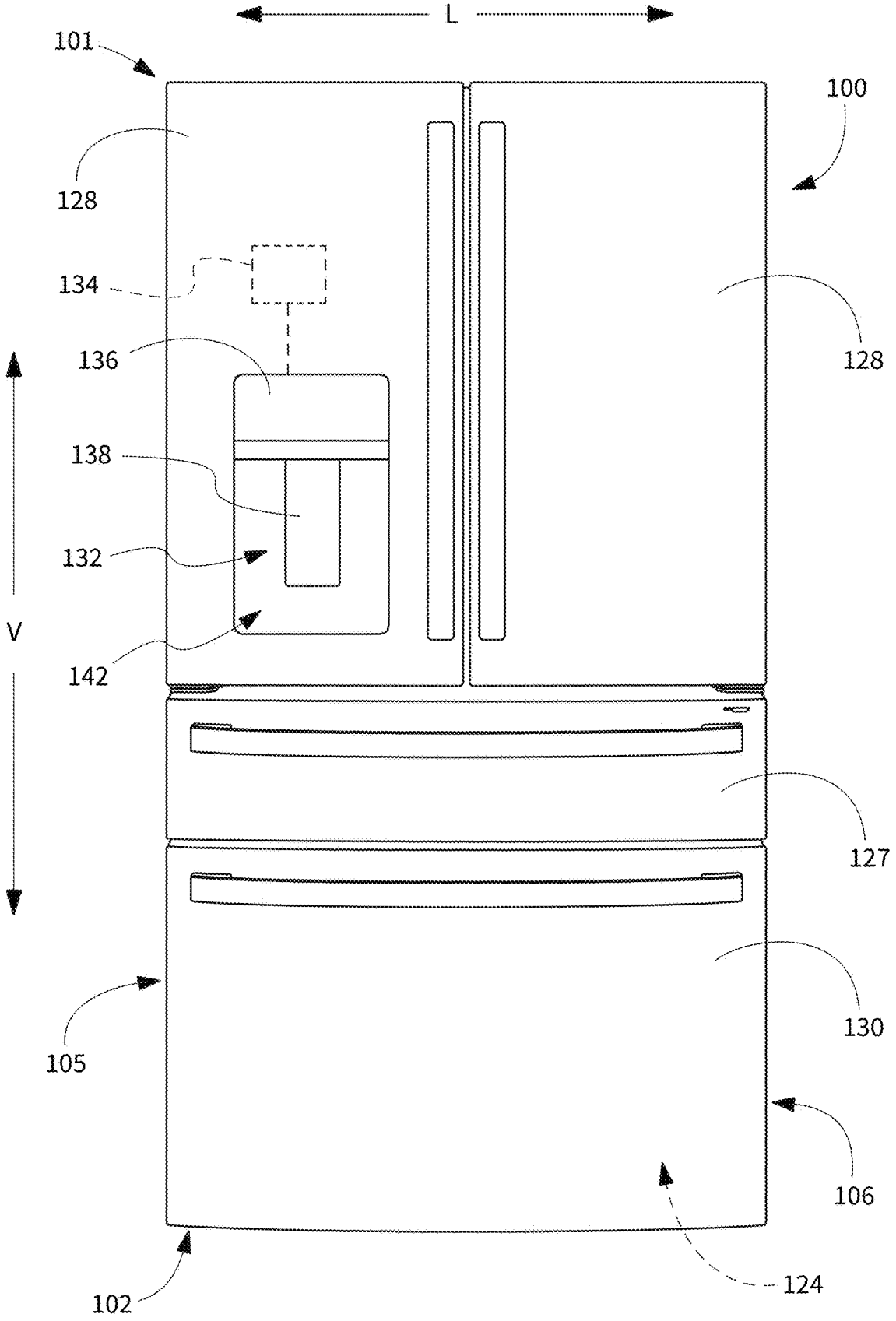
FIG. 1 provides a front view of an exemplary refrigerator appliance, according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
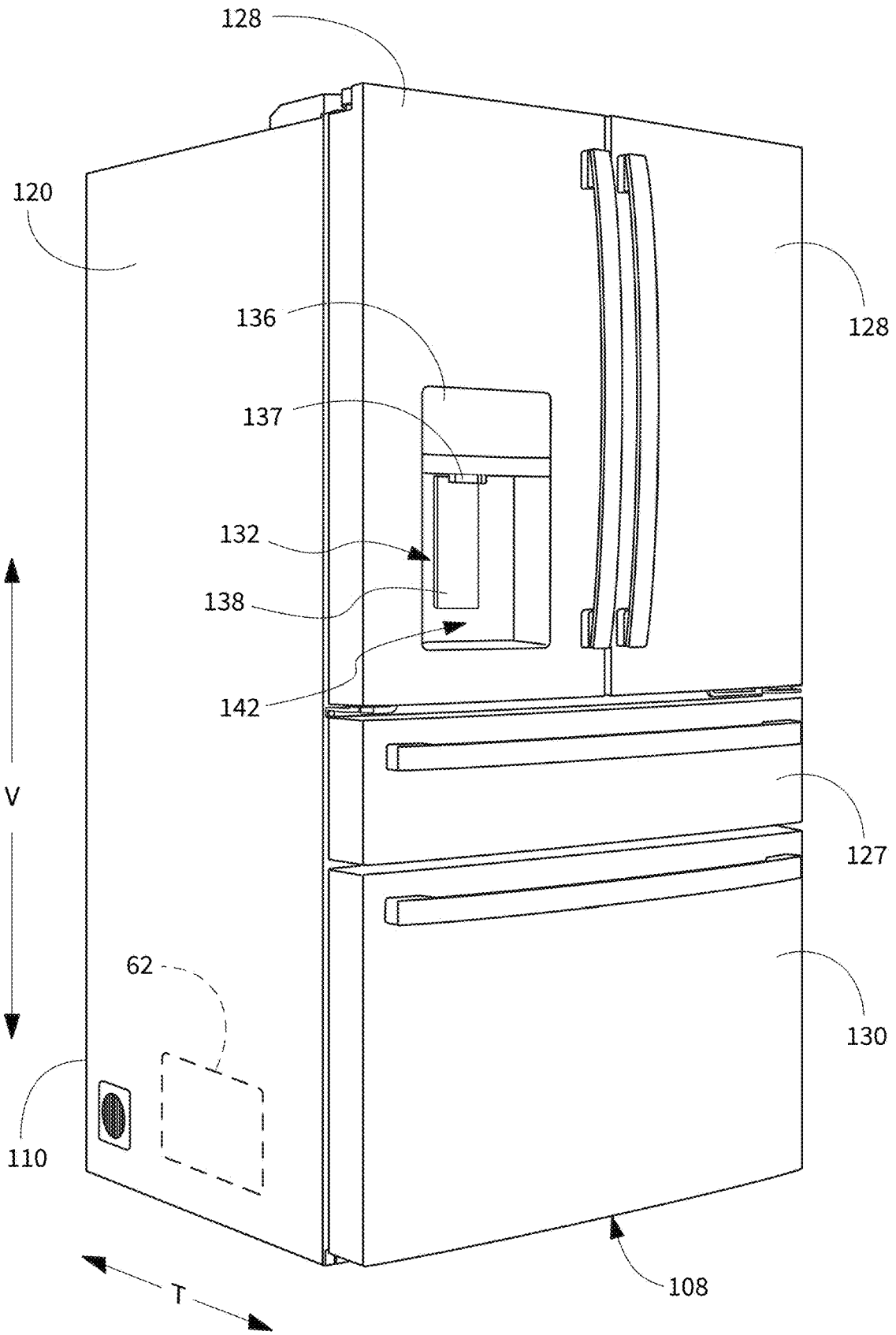
FIG. 2 provides a perspective view of the refrigerator appliance of FIG. 1.
Figure 3:
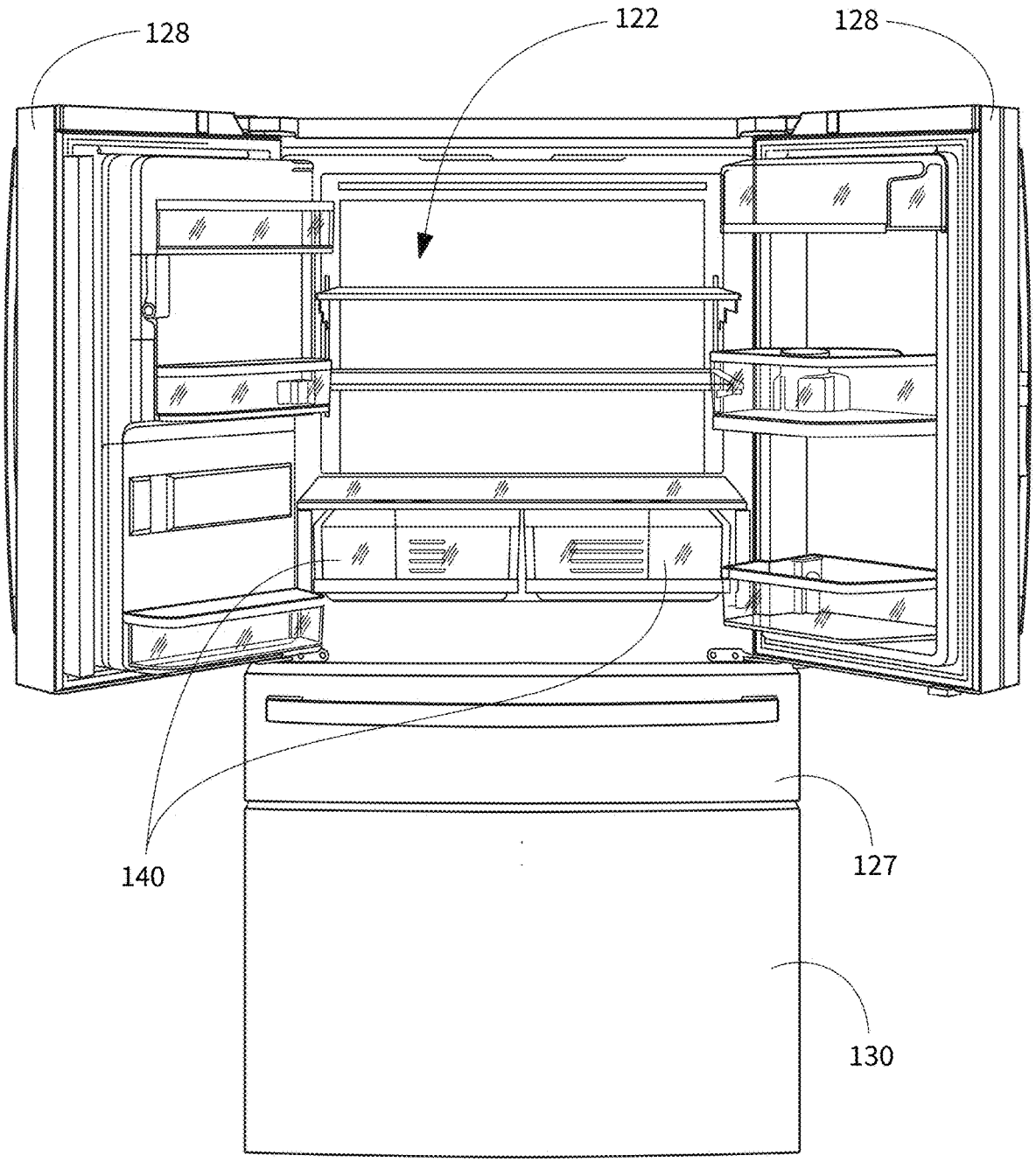
FIG. 3 provides a front view of the refrigerator appliance of FIG. 1 with doors in an open position.

FIG. 1 is a front view of an exemplary embodiment of a refrigerator appliance 100. FIG. 2 is a perspective view of the refrigerator appliance 100. FIG. 3 is a front view of the refrigerator appliance 100 with fresh food doors 128 thereof in an open position. Refrigerator appliance 100 extends between a top 101 and a bottom 102 along a vertical direction V. Refrigerator appliance 100 also extends between a first side 105 and a second side 106 along a lateral direction L which is perpendicular to the vertical direction V. As shown in FIG. 2, a transverse direction T may additionally be defined perpendicular to the vertical and lateral directions V, L. Refrigerator appliance 100 extends along the transverse direction T between a front portion 108 and a back portion 110.

Figure 4:
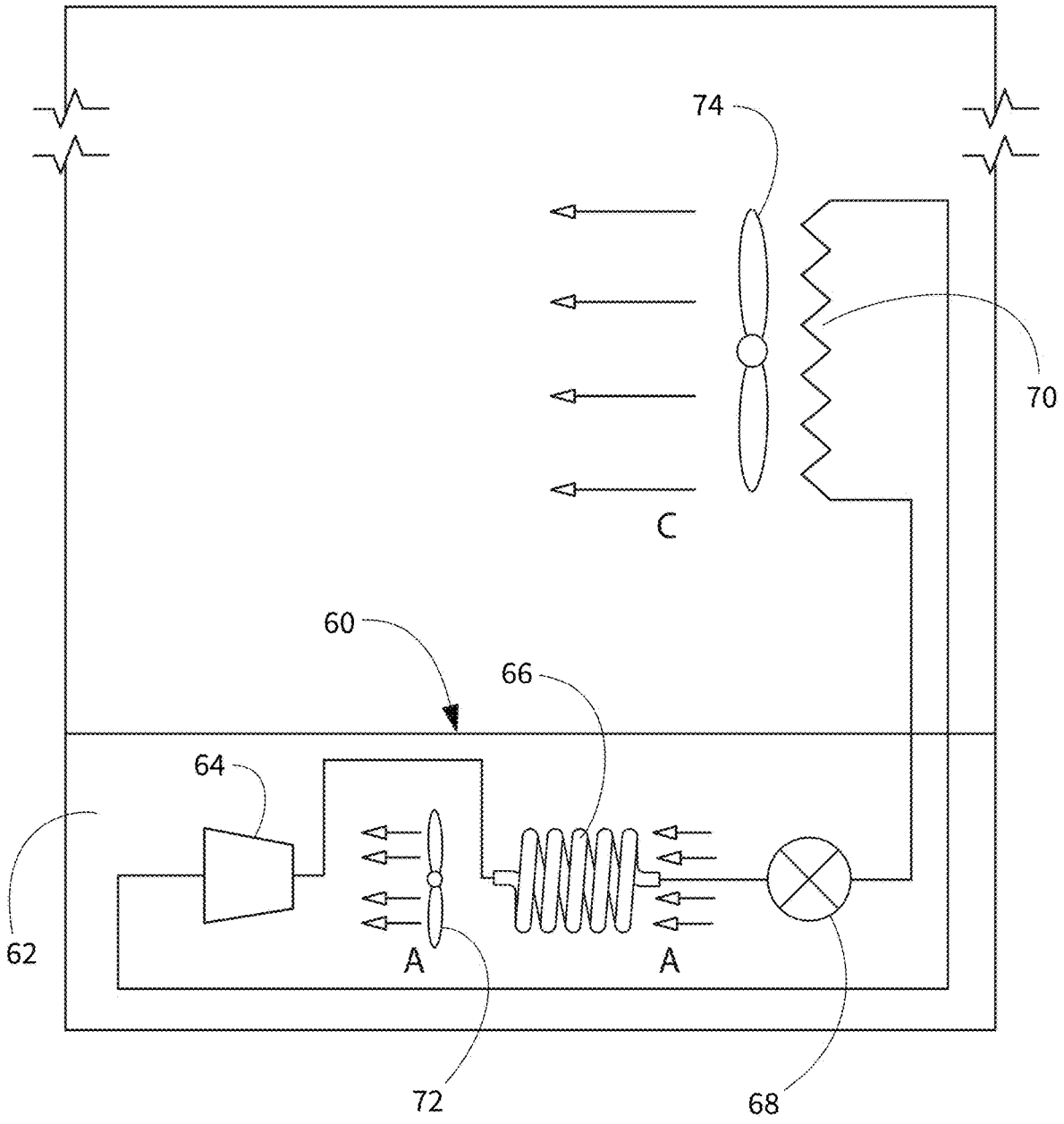
FIG. 4 provides a schematic illustration of an example sealed cooling system as may be used with a refrigerator appliance in one or more exemplary embodiments of the present subject matter.

Refrigerator appliance 100 includes a cabinet or housing 120 defining one or more chilled chambers, such as an upper fresh food chamber 122 (FIG. 3) and a lower freezer chamber or frozen food storage chamber 124 (FIG. 1) arranged below the fresh food chamber 122 along the vertical direction V. As used herein, the chambers may be "chilled" in that the chambers are operable at temperatures below room temperature, e.g., less than about seventy-five degrees Fahrenheit (75° F.). An auxiliary food storage chamber may be positioned between the fresh food storage chamber 122 and the frozen food storage chamber 124, e.g., along the vertical direction V. Because the frozen food storage chamber 124 is positioned below the fresh food storage chamber 122, refrigerator appliance 100 is generally referred to as a bottom mount refrigerator. In the exemplary embodiment, housing 120 also defines a mechanical compartment 62 (FIG. 2) for receipt of a sealed cooling system 60 (FIG. 4). Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the technology in any aspect.

Refrigerator doors 128 are each rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably mounted within freezer chamber 124. An auxiliary door 127 is coupled to an auxiliary drawer (not shown) which is slidably mounted within an auxiliary chamber (not shown). As may be seen in FIG. 3, a plurality of food storage compartments 140 are disposed within the fresh food storage chamber 122.

Operation of the refrigerator appliance 100 can be regulated by a controller 134 that is operatively coupled to a user interface panel 136. Interface panel 136 provides selections for user manipulation of the operation of refrigerator appliance 100 to modify environmental conditions therein, such as temperature selections, etc. In some embodiments, user interface panel 136 may be proximate a dispenser assembly 132. In response to user manipulation of the user interface panel 136, the controller 134 operates various components of the refrigerator appliance 100. Operation of the refrigerator appliance 100 can be regulated by the controller 134, e.g., controller 134 may regulate operation of various components of the refrigerator appliance 100 in response to programming and/or user manipulation of the user interface panel 136.

As best seen in FIGS. 1 and 2, dispensing assembly 132 includes a dispenser positioned on or mounted to an exterior portion of refrigerator appliance 100, e.g., on an outer surface of one of refrigerator doors 128. The dispenser includes a discharging outlet 137 (FIG. 2) for accessing ice and liquid water. An actuating mechanism 138, shown as a paddle, is mounted below discharging outlet 137 for operating the dispenser. In alternative exemplary embodiments, any suitable actuating mechanism may be used to operate the dispenser. For example, the dispensing assembly 132 can include a sensor (such as an ultrasonic sensor) or a button instead of or in addition to the paddle 138. The user interface panel 136 may provide for controlling the mode of operation of the dispensing assembly 132. For example, user interface panel 136 includes a plurality of user inputs (not labeled), such as a water dispensing button and an ice-dispensing button, for selecting a desired mode of operation such as crushed or non-crushed ice. Additionally, the user inputs may include inputs for selecting one of a plurality of different liquids, such as juice, carbonated water or soda, tea, etc., and/or inputs for selecting a temperature for water to be dispensed, such as chilled, room temperature, or warm, among other possible options.

Discharging outlet 137 and actuating mechanism 138 are an external part of dispenser assembly 132 and are mounted in a dispenser recess 142. Dispenser recess 142 is positioned at a predetermined elevation convenient for a user to access ice or liquids and enabling the user to access the dispensed ice and/or liquids without the need to bend-over and without the need to open refrigerator doors 128. In the exemplary embodiment, dispenser recess 142 is positioned at a level that approximates the chest level of an adult user. According to an exemplary embodiment, the dispensing assembly 132 may receive ice from an icemaker disposed in a sub-compartment of the fresh food chamber 122.

The controller 134 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. It should be noted that controllers 134 as disclosed herein are capable of and may be operable to perform any methods and associated method steps as may be disclosed herein.

The controller 134 may be positioned in a variety of locations throughout refrigerator appliance 100. In the illustrated embodiment, the controller 134 may be located within the door 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. For example, the user interface 136 may include a touchscreen providing both input and display functionality. The user interface 136 may be in communication with the controller via one or more signal lines or shared communication busses.

Using the teachings disclosed herein, one of skill in the art will understand that the present subject matter can be used with other household appliances, including other types of refrigerators such as a standalone refrigerator or freezer only unit (e.g., a column unit), a refrigerator/freezer combination, side-by-side, bottom mount, compact, and any other style or model of refrigerator appliance. Accordingly, other configurations of refrigerator appliance 100 could be provided, it being understood that the configurations shown in the accompanying figures and the description set forth herein are by way of example for illustrative purposes only.

FIG. 4 provides a schematic view of the refrigerator appliance 100, in particular the sealed cooling system 60 thereof. As illustrated in FIG. 4, refrigerator appliance 100 includes a mechanical compartment 62 that at least partially contains components for executing a known vapor compression cycle for cooling air. The components include a compressor 64, a heat exchanger or condenser 66, an expansion device 68, and an evaporator 70 connected in series and charged with a refrigerant. Evaporator 70 is also a type of heat exchanger which transfers heat from air passing over the evaporator to refrigerant flowing through evaporator 70 thereby causing the refrigerant to vaporize. As such, cooled air C is produced and configured to refrigerate at least one chamber, e.g., chambers 122 and 124, of refrigerator appliance 100. The cooled air C may be directed to the food storage chambers 122 and 124 by a fan 74.

From evaporator 70, vaporized refrigerant flows to compressor 64, which operates to increase the pressure of the refrigerant. This compression of the refrigerant raises its temperature, which is lowered by passing the gaseous refrigerant through condenser 66 where heat exchange with ambient air takes place so as to cool the refrigerant. A fan 72 is used to pull air across condenser 66, as illustrated by arrows A, so as to provide forced convection for a more rapid and efficient heat exchange between the refrigerant and the ambient air.

Expansion device 68 further reduces the pressure of refrigerant leaving condenser 66 before being fed as a liquid to evaporator 70. Collectively, the vapor compression cycle components in a refrigeration circuit, associated fans, and associated compartments are sometimes referred to as a sealed refrigeration system operable to force cold air through refrigeration chambers 122 and 124. The refrigeration system 60 depicted in FIG. 4 is provided by way of example only. It is within the scope of the present invention for other configurations of the refrigeration system to be used as well. For example, fan 74 may be repositioned so as to push air across evaporator 70, dual evaporators may be used with one or more fans, and numerous other configurations may be applied as well.

Figure 5:
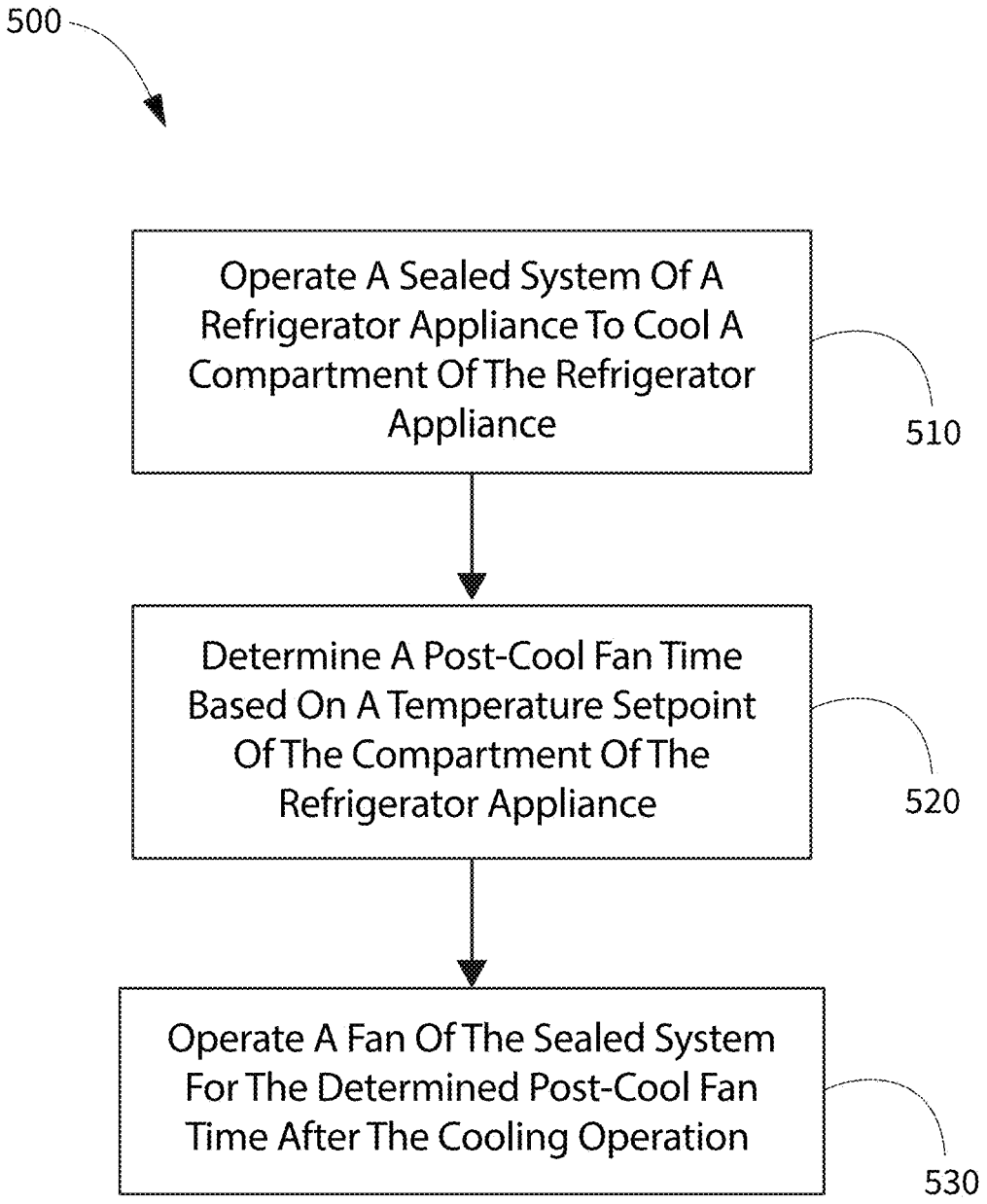
FIG. 5 provides a flow diagram of an exemplary method for operating a refrigerator appliance according to one or more exemplary embodiments of the present subject matter.

Turning now to FIG. 5, embodiments of the present disclosure also include methods of operating a refrigerator appliance, such as the refrigerator appliance described above, and which may also be used with other refrigerator appliances in various additional embodiments. Accordingly, reference numbers used in the context of the exemplary refrigerator appliance described above are provided in the discussion of method 500 by way of example only and are not intended to limit the method 500 to any particular refrigerator appliance configuration, unless the context clearly indicates otherwise.

As illustrated at (510) in FIG. 5, an exemplary method 500 may include performing a cooling cycle or cooling operation of the refrigerator appliance, e.g., in which a sealed system of the refrigerator appliance is operated to cool a compartment of the refrigerator appliance. For example, the sealed system may include a compressor 64 which may be operated to flow a refrigerant to an evaporator 70 of the refrigerator appliance, e.g., to generate a flow chilled air C. The chilled air C may be urged to or into the compartment of the refrigerator appliance, e.g., by a fan 74 of the sealed system. For example, the cooling operation may also include, while operating the compressor to flow the refrigerant to the evaporator, operating the fan to motivate the flow of air C between the evaporator and the compartment of the refrigerator appliance, and the compartment may thusly be cooled.

Methods according the present disclosure may also include a post-cooling fan operation, e.g., running (such as continuing to run) the fan 74 after the cooling operation is complete and/or when the sealed system is not actively cooling the compartment. Thus, for example, the post-cooling fan operation may be performed after stopping the flow of refrigerant to the evaporator. Stopping the flow of refrigerant to the evaporator may include stopping the flow of refrigerant through the sealed system altogether, e.g., deactivating the compressor, or, in embodiments where the refrigerator appliance includes more than one compartment and/or more than one evaporator, stopping the flow of refrigerant to the evaporator may include directing the flow of refrigerant to another evaporator of the sealed system (such as by changing the position of a multi-way valve, e.g., three-way valve, of the sealed system).

The post-cooling fan operation may be performed for a post-cooling fan time, e.g., an amount of time after the cooling operation during which the fan is operated (e.g., continues to operate). The post-cooling fan time may be dynamic rather than static, i.e., a post-cooling fan time value may be determined for each cooling cycle during and/or at the end of the cooling cycle, and the determined post-cooling fan time value may be specific to each cooling cycle. For example, methods according to embodiments of the present disclosure such as method 500 may include (520) determining a post-cool fan time based on a temperature setpoint of the compartment of the refrigerator appliance and (530) operating the fan for the determined post-cool fan time after stopping the flow of refrigerant to the evaporator.

In some embodiments, the post-cool fan time may also be determined based on one or more of a post-cool fan time slope, a default temperature setpoint of the compartment of the refrigerator appliance, a default post-cool fan time, a minimum post-cooling fan time, and/or a maximum post-cooling fan time.

For example, the post-cooling fan time may be determined, e.g., calculated, by multiplying the compartment temperature setpoint by the post-cooling fan time slope, where the post-cooling fan time slope has units of time over temperature, such that the product of the compartment temperature setpoint and the post-cooling fan time slope will provide a time value for the post-cooling fan operation. In some embodiments, the post-cooling fan time may also be determined with reference to a default compartment temperature setpoint. For example, determining the post-cooling fan time may also include calculating a mathematical difference between the temperature setpoint of the compartment of the refrigerator appliance and the default temperature setpoint of the compartment of the refrigerator appliance, such as subtracting the compartment temperature setpoint from the default compartment temperature setpoint. The mathematical difference between the temperature setpoint of the compartment of the refrigerator appliance and the default temperature setpoint of the compartment of the refrigerator appliance may then be multiplied by the post-cooling fan time slope to arrive at, e.g., determine, the post-cooling fan time value for the current (or just completed) cooling operation.

In some embodiments, a default post-cooling fan time may be added. For example, such embodiments may include multiplying a temperature value (such as the compartment temperature setpoint or the default compartment temperature setpoint minus the compartment temperature setpoint, as described above) by the post-cooling fan time slope and adding the default post-cooling fan time to the product obtained.

For example, the post-cooling fan time may be calculated according to the following formula:

Post Cool Fan Time=(Post Cool Time Slope*(Default Compartment Setpoint-Active Compartment Setpoint))+Post Cool Fan Default Time In some embodiments, the post-cooling fan time value may be a preliminary post-cooling fan time. For example, the calculated preliminary post-cooling fan time value may be compared to one or more limits, such as a minimum post-cooling fan time and/or a maximum post-cooling fan time, such that the actual post-cooling fan time which is ultimately determined and implemented may be constrained within a range defined by and between the minimum post-cooling fan time and the maximum post-cooling fan time. Thus, methods according to the present disclosure may include comparing the calculated preliminary post-cool fan time to a minimum post-cool fan time. After such comparison, the post-cooling fan time which is actually implemented, e.g., the determined post-cool fan time for which the fan is operated after stopping the flow of refrigerant to the evaporator, may be the calculated preliminary post-cool fan time when the calculated preliminary post-cool fan time is greater than the minimum post-cool fan time, and may be the minimum post-cool fan time when the calculated preliminary post-cool fan time is not greater than (i.e., is equal to or less than) the minimum post-cool fan time. Methods according to the present disclosure may also or instead include comparing the calculated preliminary post-cool fan time to a maximum post-cool fan time. In such embodiments, the post-cooling fan time which is actually implemented, e.g., the determined post-cool fan time for which the fan is operated after stopping the flow of refrigerant to the evaporator, may be the calculated preliminary post-cool fan time when the calculated preliminary post-cool fan time is less than the maximum post-cool fan time, and may be the maximum post-cool fan time when the calculated preliminary post-cool fan time is not less than (i.e., is equal to or greater than) the maximum post-cool fan time.

For example, the determined post-cooling fan time may be constrained by both the maximum post-cooling fan time and the minimum post-cooling fan time, such as exemplary methods may include comparing the calculated preliminary post-cool fan time to the minimum post-cool fan time and to the maximum post-cool fan time. In such embodiments, the determined post-cool fan time for which the fan is operated after stopping the flow of refrigerant to the evaporator may be the calculated preliminary post-cool fan time when the calculated preliminary post-cool fan time is greater than the minimum post-cool fan time and less than the maximum post-cool fan time. Also in such embodiments, the determined post-cool fan time for which the fan is operated after stopping the flow of refrigerant to the evaporator may be the minimum post-cool fan time when the calculated preliminary post-cool fan time is not greater than the minimum post-cool fan time, and the determined post-cool fan time for which the fan is operated after stopping the flow of refrigerant to the evaporator may be the maximum post-cool fan time when the calculated preliminary post-cool fan time is not less than the maximum post-cool fan time.

In further embodiments, the post-cooling fan time may be determined based on the temperature setpoint of the compartment of the refrigerator appliance by using additional or different operations, such as in a second-order function rather than a linear function. As another example, the post-cooling fan time may be determined based on the temperature setpoint of the compartment of the refrigerator appliance by looking up the compartment temperature setpoint in a lookup table and applying a post-cooling fan time value associated with the compartment temperature setpoint in the lookup table.

Those of ordinary skill in the art will recognize that the various steps of the exemplary methods described herein may be combined in various ways to arrive at additional embodiments within the scope of the present disclosure. Furthermore, the skilled artisan will recognize the interchangeability of various features from different embodiments. Similarly, the various method steps and features described, as well as other known equivalents for each such methods and feature, can be mixed and matched by one of ordinary skill in this art to construct additional systems and techniques in accordance with principles of this disclosure. Of course, it is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a refrigerator appliance, the method comprising:

operating a compressor of the refrigerator appliance to flow a refrigerant to an evaporator of the refrigerator appliance;

operating a fan to motivate a flow of air between the evaporator and a compartment of the refrigerator appliance, whereby the compartment is cooled, while operating the compressor to flow the refrigerant to the evaporator;

stopping the flow of refrigerant to the evaporator;

determining a post-cool fan time based on a temperature setpoint of the compartment of the refrigerator appliance and a post-cool fan time slope, the post-cool fan time slope having units of time over temperature; and operating the fan for the determined post-cool fan time after stopping the flow of refrigerant to the evaporator.

2. The method of claim 1, wherein determining the post-cool fan time based on the temperature setpoint of the compartment of the refrigerator appliance and the post-cool fan time slope comprises calculating a preliminary post-cool fan time using the temperature setpoint of the compartment and the post-cool fan time slope, and comparing the calculated preliminary post-cool fan time to a minimum post-cool fan time, wherein the determined post-cool fan time for which the fan is operated after stopping the flow of refrigerant to the evaporator is the calculated preliminary post-cool fan time when the calculated preliminary post-cool fan time is greater than the minimum post-cool fan time, and wherein the determined post-cool fan time for which the fan is operated after stopping the flow of refrigerant to the evaporator is the minimum post-cool fan time when the calculated preliminary post-cool fan time is not greater than the minimum post-cool fan time.

3. The method of claim 1, wherein determining the post-cool fan time based on the temperature setpoint of the compartment of the refrigerator appliance and the post-cool fan time slope comprises calculating a preliminary post-cool fan time using the temperature setpoint of the compartment and the post-cool fan time slope, and comparing the calculated preliminary post-cool fan time to a maximum post-cool fan time, wherein the determined post-cool fan time for which the fan is operated after stopping the flow of refrigerant to the evaporator is the calculated preliminary post-cool fan time when the calculated preliminary post-cool fan time is less than the maximum post-cool fan time, and wherein the determined post-cool fan time for which the fan is operated after stopping the flow of refrigerant to the evaporator is the maximum post-cool fan time when the calculated preliminary post-cool fan time is not less than the maximum post-cool fan time.

4. The method of claim 1, wherein determining the post-cool fan time based on the temperature setpoint of the compartment of the refrigerator appliance and the post-cool fan time slope comprises calculating a preliminary post-cool fan time, and wherein calculating the preliminary post-cool fan time comprises multiplying the post-cool fan time slope by a mathematical difference between the temperature setpoint of the compartment of the refrigerator appliance and a default temperature setpoint of the compartment of the refrigerator appliance.

5. The method of claim 4, wherein calculating the preliminary post-cool fan time further comprises adding a default post-cool fan time to the product of the post-cool fan time slope and the mathematical difference between the temperature setpoint of the compartment of the refrigerator appliance and the default temperature setpoint of the compartment of the refrigerator appliance.

6. The method of claim 5, further comprising comparing the calculated preliminary post-cool fan time to a minimum post-cool fan time and to a maximum post-cool fan time, wherein the determined post-cool fan time for which the fan is operated after stopping the flow of refrigerant to the evaporator is the calculated preliminary post-cool fan time when the calculated preliminary post-cool fan time is greater than the minimum post-cool fan time and less than the maximum post-cool fan time, wherein the determined post-cool fan time for which the fan is operated after stopping the flow of refrigerant to the evaporator is the minimum post-cool fan time when the calculated preliminary post-cool fan time is not greater than the minimum post-cool fan time, and wherein the determined post-cool fan time for which the fan is operated after stopping the flow of refrigerant to the evaporator is the maximum post-cool fan time when the calculated preliminary post-cool fan time is not less than the maximum post-cool fan time.

7. A refrigerator appliance, comprising:

a compressor;

an evaporator;

a fan;

a compartment; and a controller, the controller configured for:

operating the compressor to flow a refrigerant to the evaporator;

operating the fan to motivate a flow of air between the evaporator and the compartment, whereby the compartment is cooled, while operating the compressor to flow the refrigerant to the evaporator;

stopping the flow of refrigerant to the evaporator;

determining a post-cool fan time based on a temperature setpoint of the compartment of the refrigerator appliance and a default temperature setpoint of the compartment of the refrigerator appliance; and operating the fan for the determined post-cool fan time after stopping the flow of refrigerant to the evaporator.

8. The refrigerator appliance of claim 7, wherein determining the post-cool fan time based on the temperature setpoint of the compartment of the refrigerator appliance and the default temperature setpoint of the compartment of the refrigerator appliance comprises calculating a preliminary post-cool fan time using the temperature setpoint of the compartment and the default temperature setpoint of the compartment of the refrigerator appliance, and comparing the calculated preliminary post-cool fan time to a minimum post-cool fan time, wherein the determined post-cool fan time for which the fan is operated after stopping the flow of refrigerant to the evaporator is the calculated preliminary post-cool fan time when the calculated preliminary post-cool fan time is greater than the minimum post-cool fan time, and wherein the determined post-cool fan time for which the fan is operated after stopping the flow of refrigerant to the evaporator is the minimum post-cool fan time when the calculated preliminary post-cool fan time is not greater than the minimum post-cool fan time.

9. The refrigerator appliance of claim 7, wherein determining the post-cool fan time based on the temperature setpoint of the compartment of the refrigerator appliance and the default temperature setpoint of the compartment of the refrigerator appliance comprises calculating a preliminary post-cool fan time using the temperature setpoint of the compartment and the default temperature setpoint of the compartment of the refrigerator appliance, and comparing the calculated preliminary post-cool fan time to a maximum post-cool fan time, wherein the determined post-cool fan time for which the fan is operated after stopping the flow of refrigerant to the evaporator is the calculated preliminary post-cool fan time when the calculated preliminary post-cool fan time is less than the maximum post-cool fan time, and wherein the determined post-cool fan time for which the fan is operated after stopping the flow of refrigerant to the evaporator is the maximum post-cool fan time when the calculated preliminary post-cool fan time is not less than the maximum post-cool fan time.

10. The refrigerator appliance of claim 7, wherein determining the post-cool fan time based on the temperature setpoint of the compartment of the refrigerator appliance and the default temperature setpoint of the compartment of the refrigerator appliance comprises calculating a preliminary post-cool fan time, and wherein calculating the preliminary post-cool fan time comprises multiplying a post-cool fan time slope by a mathematical difference between the temperature setpoint of the compartment of the refrigerator appliance and the default temperature setpoint of the compartment of the refrigerator appliance, wherein the post-cool fan time slope has units of time over temperature.

11. The refrigerator appliance of claim 10, wherein calculating the preliminary post-cool fan time further comprises adding a default post-cool fan time to the product of the post-cool fan time slope and the mathematical difference between the temperature setpoint of the compartment of the refrigerator appliance and the default temperature setpoint of the compartment of the refrigerator appliance.

12. The refrigerator appliance of claim 11, further comprising comparing the calculated preliminary post-cool fan time to a minimum post-cool fan time and to a maximum post-cool fan time, wherein the determined post-cool fan time for which the fan is operated after stopping the flow of refrigerant to the evaporator is the calculated preliminary post-cool fan time when the calculated preliminary post-cool fan time is greater than the minimum post-cool fan time and less than the maximum post-cool fan time, wherein the determined post-cool fan time for which the fan is operated after stopping the flow of refrigerant to the evaporator is the minimum post-cool fan time when the calculated preliminary post-cool fan time is not greater than the minimum post-cool fan time, and wherein the determined post-cool fan time for which the fan is operated after stopping the flow of refrigerant to the evaporator is the maximum post-cool fan time when the calculated preliminary post-cool fan time is not less than the maximum post-cool fan time.

13. A refrigerator appliance, comprising:

a compressor;

an evaporator;

a fan;

a compartment; and a controller, the controller configured for:

operating the compressor to flow a refrigerant to the evaporator;

operating the fan to motivate a flow of air between the evaporator and the compartment, whereby the compartment is cooled, while operating the compressor to flow the refrigerant to the evaporator;

stopping the flow of refrigerant to the evaporator;

determining a post-cool fan time based on a temperature setpoint of the compartment of the refrigerator appliance and a default post-cool fan time; and operating the fan for the determined post-cool fan time after stopping the flow of refrigerant to the evaporator.

14. The refrigerator appliance of claim 13, wherein determining the post-cool fan time based on the temperature setpoint of the compartment of the refrigerator appliance and the default post-cool fan time comprises calculating a preliminary post-cool fan time using the temperature setpoint of the compartment and the default post-cool fan time, and comparing the calculated preliminary post-cool fan time to a minimum post-cool fan time, wherein the determined post-cool fan time for which the fan is operated after stopping the flow of refrigerant to the evaporator is the calculated preliminary post-cool fan time when the calculated preliminary post-cool fan time is greater than the minimum post-cool fan time, and wherein the determined post-cool fan time for which the fan is operated after stopping the flow of refrigerant to the evaporator is the minimum post-cool fan time when the calculated preliminary post-cool fan time is not greater than the minimum post-cool fan time.

15. The refrigerator appliance of claim 13, wherein determining the post-cool fan time based on the temperature setpoint of the compartment of the refrigerator appliance and the default post-cool fan time comprises calculating a preliminary post-cool fan time using the temperature setpoint of the compartment and the default post-cool fan time, and comparing the calculated preliminary post-cool fan time to a maximum post-cool fan time, wherein the determined post-cool fan time for which the fan is operated after stopping the flow of refrigerant to the evaporator is the calculated preliminary post-cool fan time when the calculated preliminary post-cool fan time is less than the maximum post-cool fan time, and wherein the determined post-cool fan time for which the fan is operated after stopping the flow of refrigerant to the evaporator is the maximum post-cool fan time when the calculated preliminary post-cool fan time is not less than the maximum post-cool fan time.

16. The refrigerator appliance of claim 13, wherein determining the post-cool fan time based on the temperature setpoint of the compartment of the refrigerator appliance and the default post-cool fan time comprises calculating a preliminary post-cool fan time, and wherein calculating the preliminary post-cool fan time comprises multiplying a post-cool fan time slope by a mathematical difference between the temperature setpoint of the compartment of the refrigerator appliance and a default temperature setpoint of the compartment of the refrigerator appliance, wherein the post-cool fan time slope has units of time over temperature.

17. The refrigerator appliance of claim 16, wherein calculating the preliminary post-cool fan time further comprises adding the default post-cool fan time to the product of the post-cool fan time slope and the mathematical difference between the temperature setpoint of the compartment of the refrigerator appliance and the default temperature setpoint of the compartment of the refrigerator appliance.

18. The refrigerator appliance of claim 17, wherein the controller is further configured for comparing the calculated preliminary post-cool fan time to a minimum post-cool fan time and to a maximum post-cool fan time, wherein the determined post-cool fan time for which the fan is operated after stopping the flow of refrigerant to the evaporator is the calculated preliminary post-cool fan time when the calculated preliminary post-cool fan time is greater than the minimum post-cool fan time and less than the maximum post-cool fan time, wherein the determined post-cool fan time for which the fan is operated after stopping the flow of refrigerant to the evaporator is the minimum post-cool fan time when the calculated preliminary post-cool fan time is not greater than the minimum post-cool fan time, and wherein the determined post-cool fan time for which the fan is operated after stopping the flow of refrigerant to the evaporator is the maximum post-cool fan time when the calculated preliminary post-cool fan time is not less than the maximum post-cool fan time.

* * * * *